US011284699B2

(12) United States Patent
Fontaine

(10) Patent No.: US 11,284,699 B2
(45) Date of Patent: Mar. 29, 2022

(54) BODY-WORN AID FOR DECEDENT REMOVAL AND OTHER LOAD-MOVING APPLICATIONS

(71) Applicant: Rolland Fontaine, Selkirk (CA)

(72) Inventor: Rolland Fontaine, Selkirk (CA)

( * ) Notice: Subject to any disclaimer, the term of this patent is extended or adjusted under 35 U.S.C. 154(b) by 0 days.

(21) Appl. No.: 16/786,114

(22) Filed: Feb. 10, 2020

(65) Prior Publication Data

US 2021/0244160 A1 Aug. 12, 2021

(51) Int. Cl.
*A45F 3/14* (2006.01)
*A45F 3/04* (2006.01)

(52) U.S. Cl.
CPC ..... *A45F 3/14* (2013.01); *A45F 3/04* (2013.01); *A45F 2003/142* (2013.01)

(58) Field of Classification Search
CPC ..... A45F 3/14; A45F 3/04; A45F 2003/142
USPC ..... 224/646, 158, 268, 269, 266
See application file for complete search history.

(56) References Cited

U.S. PATENT DOCUMENTS 87,844 A * 3/1869 Hale ..... B66C 1/422 294/118
1,178,628 A * 4/1916 Clawson ..... A45F 3/14 224/259
1,473,477 A * 11/1923 Fick ..... A45F 3/14 224/265
1,535,208 A * 4/1925 Drennan ..... A61G 7/1088 224/158
1,542,163 A * 6/1925 Morde ..... A45F 3/14 224/646
1,727,873 A * 9/1929 Farmer, Jr. ..... A45F 3/14 224/260
1,879,480 A * 9/1932 Pures ..... A45F 3/14 224/260
2,169,080 A * 8/1939 Clark ..... A45F 3/14 224/639
2,718,988 A * 9/1955 Potts ..... A45F 5/00 224/609
2,855,133 A * 10/1958 Mullin ..... A45F 3/14 224/184
2,931,629 A * 4/1960 Keller ..... A01M 31/00 254/409
2,996,228 A * 8/1961 Bauman ..... A01M 31/006 224/184

(Continued)

*Primary Examiner* — Peter N Helvey
(74) *Attorney, Agent, or Firm* — Kyle R Satterthwaite; Ryan W Dupuis; Ade & Company Inc.

(57) ABSTRACT

A carrying aid for hands-free carrying of a load in a suspended state between the two users, for example to transport a decedent body in a cadaver bag. Each carrying aid features a body-worn harness adorned over the user's shoulders, a securement member connected to and supported by the harness at a position approximately midway point across the user's body, and a yoke attached to the harness by the securement member. The yoke has a pair of diverging support arms spanning laterally outward from their attachment to the securement member. Each support arm carries a respective coupling component by which the yoke is connectable to a cadaver bag or other carrier on or in which a load is to be borne. Two users adorn respective aids with their yokes respectively situated anteriorly and posteriorly of the two users, who can both therefore face and walk forwardly in the travel direction.

16 Claims, 3 Drawing Sheets

(56) References Cited

U.S. PATENT DOCUMENTS 3,181,752 A * 5/1965 Seltzer ..... A45C 13/38 224/260
3,357,613 A * 12/1967 Chase ..... A45F 3/14 224/162
3,486,671 A * 12/1969 Sanders ..... A61G 1/04 224/576
3,659,760 A * 5/1972 Blood ..... A45F 3/15 224/157
4,280,645 A * 7/1981 Goodden ..... A45F 3/14 224/259
4,487,347 A * 12/1984 Zegar ..... A45F 3/04 206/315.5
D287,111 S * 12/1986 Walker ..... D12/11
4,634,032 A * 1/1987 LaFlame ..... G10G 5/005 224/265
4,776,504 A * 10/1988 Panth ..... A45F 5/00 224/197
4,780,940 A * 11/1988 Jay ..... A61G 17/06 27/28
5,009,349 A * 4/1991 Eide ..... A45F 5/00 224/260
5,215,239 A * 6/1993 Walters, Jr. ..... A45F 5/00 224/259
5,307,967 A * 5/1994 Seals ..... A45F 3/14 224/257
5,573,158 A * 11/1996 Penn ..... G10G 5/00 224/265
5,588,940 A * 12/1996 Price ..... A63B 21/065 224/259
5,950,886 A * 9/1999 Maupin ..... A61G 1/04 224/157
7,394,008 B2 * 7/2008 May ..... G10G 5/005 224/265
7,554,024 B2 * 6/2009 Miyajima ..... G10G 5/005 224/265
7,576,276 B2 * 8/2009 Hallerberg ..... G10G 5/005 224/265
7,780,049 B1 * 8/2010 Baranoski ..... A45F 3/14 224/250
8,053,655 B2 * 11/2011 May ..... G10G 5/005 84/421
8,657,166 B1 * 2/2014 Harness ..... A45F 5/021 224/259
8,807,403 B2 * 8/2014 Nielsen ..... B65G 7/12 224/157
8,857,682 B2 * 10/2014 Nakaya ..... A01D 34/902 224/257
9,930,955 B2 * 4/2018 Nielsen ..... A45F 3/14
9,932,208 B2 * 4/2018 Mealy ..... A62B 35/0075
2002/0148866 A1 * 10/2002 Dent, III ..... A45F 3/14 224/259
2002/0179665 A1 * 12/2002 Krane ..... A45F 5/00 224/646
2004/0011841 A1 * 1/2004 Sprague ..... A45C 13/30 224/638
2004/0056056 A1 * 3/2004 Fabricius ..... A45F 3/14 224/262
2004/0211799 A1 * 10/2004 Loughman ..... F16M 11/10 224/262
2005/0045687 A1 * 3/2005 Willows ..... G08B 5/004 224/637
2005/0263551 A1 * 12/2005 Dent, III ..... A45F 3/14 224/259
2005/0279791 A1 * 12/2005 Komorowski ..... A45F 3/14 224/260
2006/0175365 A1 * 8/2006 Sandler ..... A45F 3/14 224/201
2007/0068987 A1 * 3/2007 Whitehead, III ..... A45F 3/14 224/637
2009/0014483 A1 * 1/2009 Green ..... A45F 3/14 224/157
2009/0045235 A1 * 2/2009 May ..... G10G 5/005 224/246
2009/0294500 A1 * 12/2009 Brown ..... A45F 3/14 224/651
2015/0201738 A1 * 7/2015 Lourie ..... A45F 3/10 224/266
2016/0183665 A1 * 6/2016 Nielsen ..... A45F 3/14 224/157

* cited by examiner

BODY-WORN AID FOR DECEDENT REMOVAL AND OTHER LOAD-MOVING APPLICATIONS

FIELD OF THE INVENTION

The present invention relates generally to body-worn devices for use in moving burdensome loads of notable weight, for example carrying of a human body or other load in a co-operably suspended fashion between two workers.

BACKGROUND

Devices of the general forgoing type have been previously known in the field of emergency rescue, where vests or harnesses worn by two rescue personnel are used to support a litter or stretcher in suspended relation between rescue personnel. Other carrying aids are also known in the field of furniture/applicant moving and delivery, where worker-borne harnesses are used to suspend one or more flexible straps between a pair of workers in order to bear the weight of heavy and/or large furniture or appliances.

Examples of such equipment in the field of emergency rescue can be seen in U.S. Pat. Nos. 1,096,489, 3,486,671, 5,466,040, 5,890,227, 5,950,886, 8,066,161, 8,336,141, 8,590,077 and 9,925,097. One example in the context of furniture delivery and moving can be seen in U.S. Pat. No. 6,508,389.

Applicant has realized a need for similar load carrying assistance in the field of decedent removal, where manual extraction of a human decedent from their place of passage in a cadaver bag can prove challenging, especially in the event of overweight decedents, difficult terrain and/or challenging or constrained environments.

However, the prior art carrying aids from other fields of endeavour were not specifically designed for use with cadaver bags, and thus leave notable room for improvement in this unique context.

SUMMARY OF THE INVENTION

According to an aspect of the invention there is provided a load-moving aid comprising:

a body-worn harness comprising first and second halves to be respectively worn over a user's two shoulders in a worn position of said body-worn harness;

a securement member connected to and cooperatively supported by the first and second halves of the body-worn harness at a position selected to reside at an approximate midway point across a body of the user in a worn position of said body-worn harness;

a yoke attached to, or configured for selective attachment to, the body-worn harness by the securement member, said yoke having a pair of support arms diverging away from one another from a shared connection therebetween at which the yoke is attached, or configured for selective attachment to, the securement member; and on each support arm of the yoke, adjacent a distal end of the support arm situated opposite the shared connection between the support arms, a respective coupling component by which the yoke is connectable, directly or indirectly, to a load to be moved.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
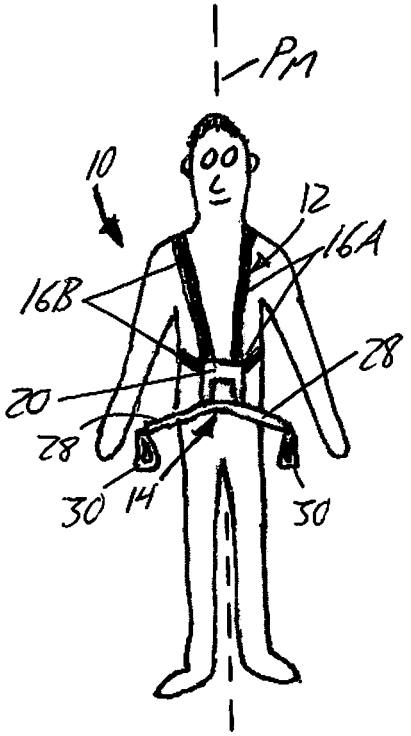
FIG. 1 is a front elevational view of a user wearing a carrying aid of the present invention in a front working position.
Figure 2:
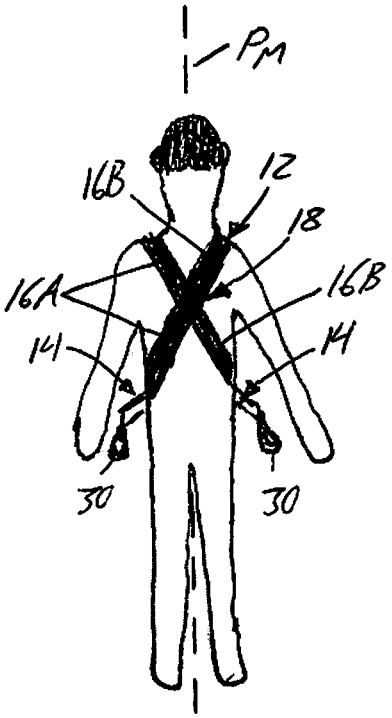
FIG. 2 is a rear elevational view the user and carrying aid of FIG. 1.

FIGS. 1 and 2 illustrate a carrying aid 10 of the present invention when worn in a front working position by a user for the purpose of partially bearing the weight of a physical load carried between this user, and another user wearing another matching carrying aid of the same construction. The carrying aid 10 is composed of two primary components, namely a body-worn harness 12 for carrying of the aid 10 on the user's body in a hands-free manner, and an accompanying support yoke 14 removably attachable to the harness 12 and suitably shaped and equipped for connection to a separate carrier on or in which the load is carried. Though focus is made herein on situations where the load is the body of a human decedent, and the carrier is accordingly a cadaver bag, it will be appreciated that a pair of carrying aids 10 of the present invention may alternatively be employed for the purpose of carrying other load types on or in any variety of carrier that is connectable to the support yokes 14 of the aids 10.

The harness 12 in the illustrated example is composed of a singular endless length of webbing or other flexible strap material that crosses over itself, and is sewn or otherwise attached to itself, at an intersection area 18 of the harness 12, and thereby forms two shoulder loops of equal size to one another on opposite sides of the intersection area. The intersection area 18 of the harness thus resides at a central mid-plane of the harness, which when worn by the user coincides with the median plane of the wearer's body, i.e. a vertical reference plane cutting centrally through the wearer's body in both an anterior-posterior direction (front to back) and a superior-inferior direction (head to toe). The two shoulder loops thus define two symmetric halves of the harness 20 that are disposed on opposing sides of the user's median plane so as to be respectively worn over the user's two shoulders.

The mid-plane of the harness and the median plane of the user, being coincident with one another in the worn position of the harness, are both denoted with reference character $P_M$ in the accompanying drawings. The portion of the harness denoting each shoulder loop is referred to herein as a respective "shoulder strap" 16A, 16B, though as mentioned above, both "straps" may in fact be integrally defined by a singular unitary strap sewn into an endless double-loop form, which if laid out flat would resemble a figure-eight or infinity symbol, if not for the fact that the two loops are joined together by a securement bracket 20, as described in more detail below.

When the carrying aid 10 is worn in the front working position shown in FIGS. 1 and 2, the intersection area 18 of the harness resides midway across the user's upper back at the user's median plane, as shown in FIG. 2. Still referring to the front working position of FIGS. 1 and 2, from the intersection area 18, each shoulder strap 16A, 16B spans diagonally upward and then wraps anteriorly over a respective one of the user's shoulders, from which the shoulder strap 16, 16B hangs anteriorly downward over the user's chest down toward the user's waistline. At or near the waistline, for example preferably at an elevation no higher than abdominal level and no lower than thigh-level, and more preferably no lower than groin level, each shoulder strap 16A, 16B is joined to a securement bracket 20, by passage of the strap 16A, 16B through a respective slot 22A, 22B in the securement bracket 20. The securement bracket 20 is bisected by the midplane $P_M$ of the harness. Each of the two slots 22A, 22B resides on a respective side of the midplane $P_M$, and is oriented to slope downwardly and laterally away therefrom near a top end of the bracket 20. The securement bracket 20 thus joins the two shoulder straps together at a generally midway point across the user's body at or near waist level, specifically at the anterior side of the user's body when worn in the front working position of FIGS. 1 and 2.

From its routing point through a respective slot 22A, 22B in the securement bracket 20, each shoulder strap 16A, 16B then extends laterally outward from the securement bracket 20 and then posteriorly around the lateral side of the user's torso, on the same side thereof as the shoulder from which this same shoulder strap 16A, 16B was routed to the securement bracket 20. From the user's lateral side, the shoulder strap 16A, 16B then angles inwardly and upwardly along the user's back, back up to the intersection area 18 where the two straps 16A, 16B are joined together. When the harness 12 is worn in the front working position, each shoulder strap 16*a*, 16B thus occupies only a respective lateral half of the user's torso, wrapping forwardly over the shoulder and down to the securement bracket 20 worn generally midway across the anterior waist, abdomen, groin or thigh area; and then wrapping rearwardly around the lateral side of the torso and connecting up with the other shoulder strap midway across the user's back.

Figure 3:
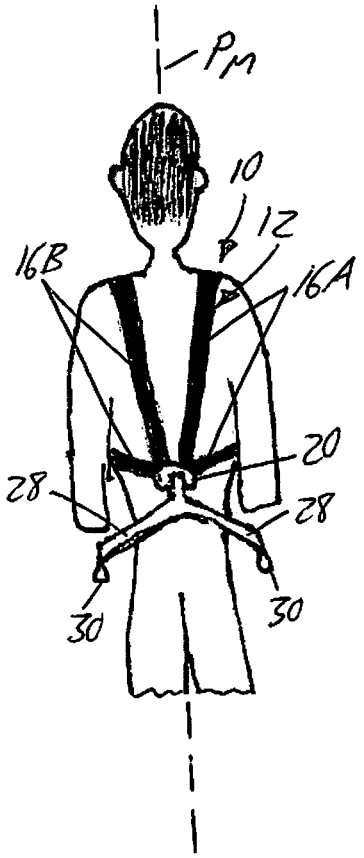
FIG. 3 is a rear elevational view of a user wearing the carrying aid of FIG. 1 in a rear working position.
Figure 4:
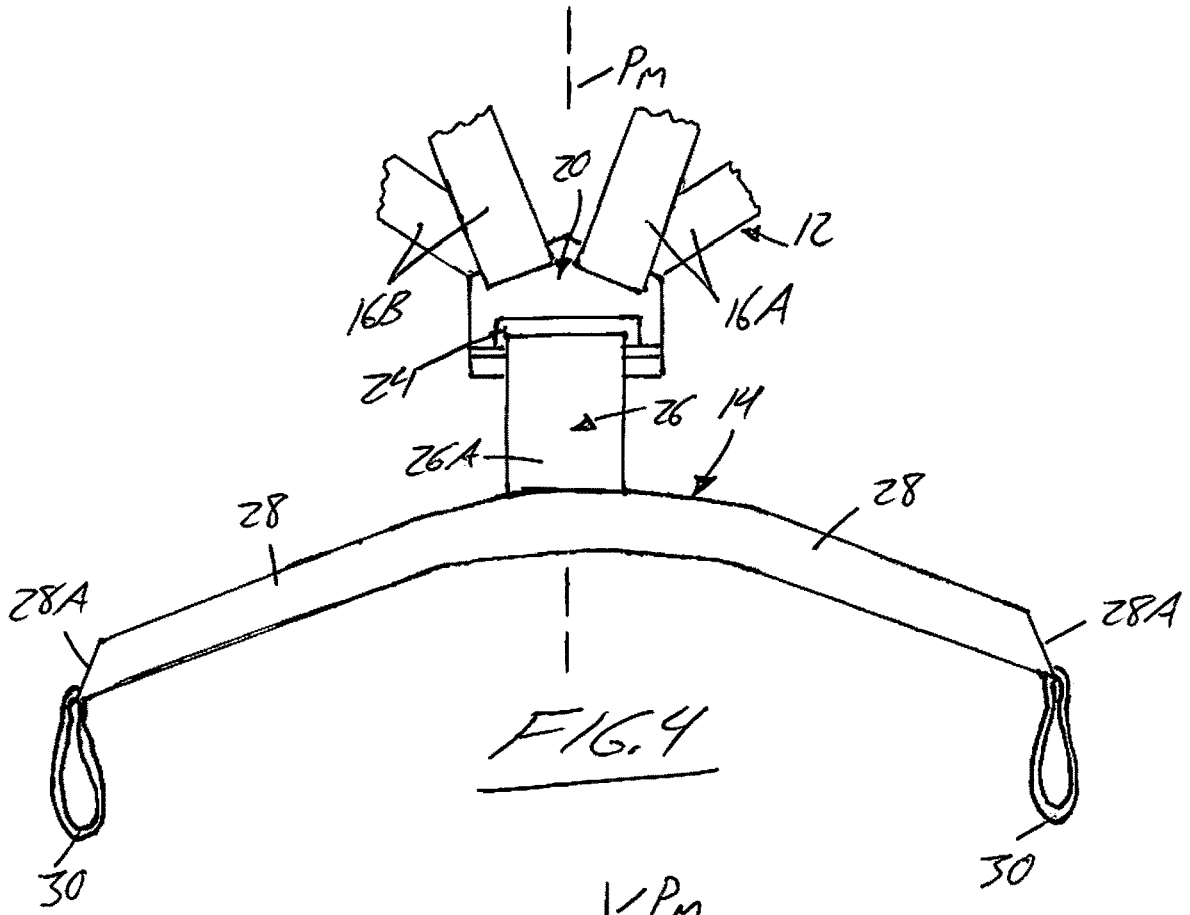
FIG. 4 is a partial front elevational view of the carrying aid of FIG. 1, illustrating connection between a body-worn harness of the carrying aid and a removable support yoke thereof.
Figure 5:
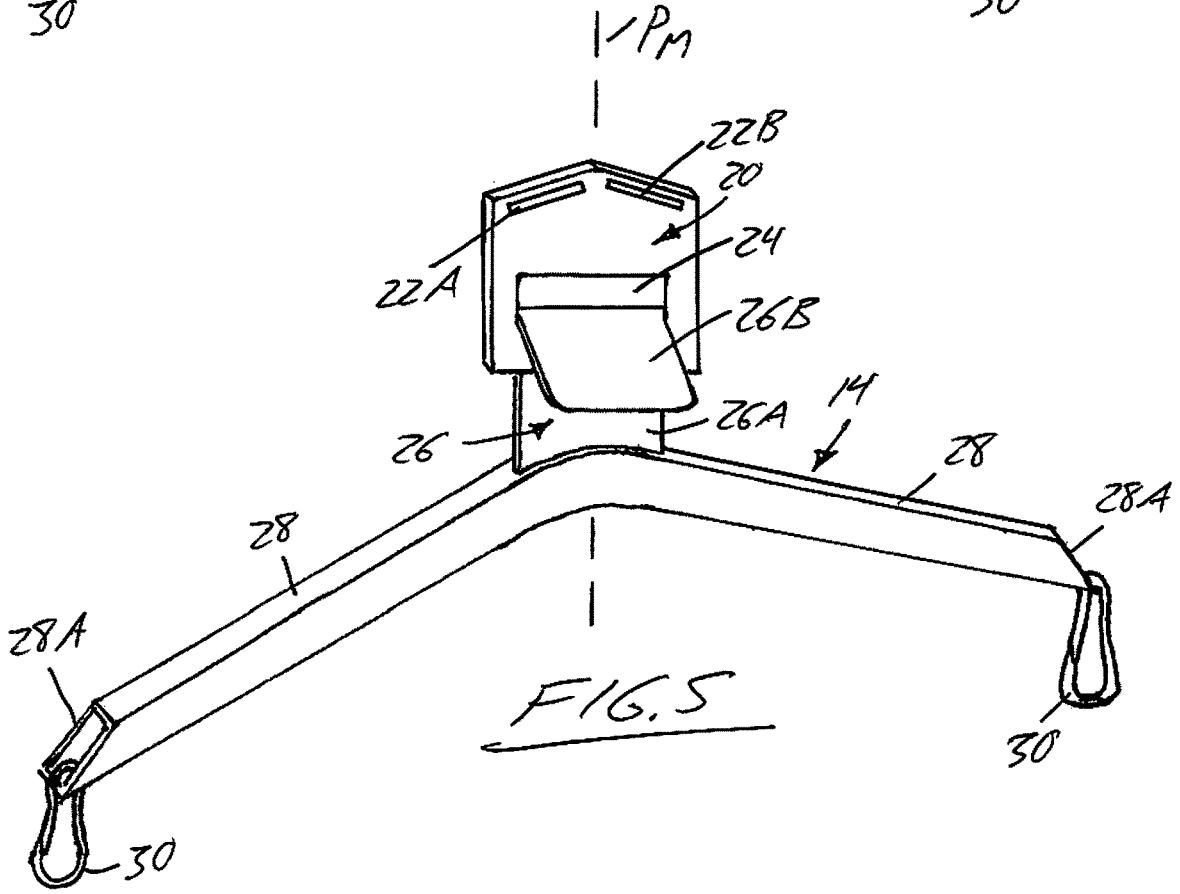
FIG. 5 is a rear perspective view of the connection between the body-worn harness and the removable support yoke.

FIG. 3 shows the carrying aid 10 instead being worn in a rear working position of reversed orientation relative to the above-described front working position. Expressed another way, the rear working position mirrors the front working position across the coronal plane of the user's body. Accordingly, in the rear working position, the intersection area 18 of the harness 12 resides midway across the chest of the user, while the securement bracket 20 resides midway across the posterior side of the user at approximately waist level, for example preferably at an elevation no higher than the lower back and no lower than thigh-level, and more preferably no lower than buttock level. As described in more detail below, a pair of the carrying aids 10 are preferably worn and used by two users in a co-operable manner, often with the two aids 10 worn in mirrored relation to one another, where first user wears his/her carrying aid 10 in the rear working position of FIG. 3 and a second user wears his/her carrying aid 10 in the front working position of FIGS. 1 and 2.

The securement bracket 20, in addition to the two strap-receiving slots 22A, 22B near the top end thereof, features an attachment opening 24 therein near a bottom end thereof. It is by way of this attachment opening 24 that the support yoke 14 is selectively attachable to, and detachable from, the securement bracket 20. The support yoke 14 features an attachment member 26 having an upright base 26A and a bent upper hook 26B that deviates from a plane of the upright base 26A, and angles obliquely downward from a top end of the upright base 26A on one side thereof. This upper hook 26B is sized for insertion thereof through the attachment opening 24 of the securement bracket 20 in the same anterior-posterior direction in which the shoulder straps 16A, 16B pass through the slots 22A, 22B. The upper hook 26B of the attachment member 26 engages over the bottom edge of the attachment opening 24 in the securement bracket 20. The weight of the support yoke 14, and any load connected thereto, thus gravitationally maintains the upper hook 26B of the support yoke 14 in this engaged state with the securement bracket 20 to maintain the securement bracket 20 and support yoke 14 in coupled connection to one another. To detach the support yoke 14 from the securement bracket 20 when use of the carrying aid is not required, the user simply lifts and tilts the support yoke 14 to withdraw the upper hook 26B of the attachment member 26 from the attachment opening 24 of the securement bracket, thereby separating the support yoke 14 therefrom.

The support yoke 14 also features a pair of diverging support arms 28 affixed to the base 26A of the attachment member 26 at the bottom end thereof. The support arms 28 angle downwardly and outwardly from the attachment member 26 on laterally opposing sides thereof. Accordingly, when the harness 12 is worn and the support yoke 14 is attached to the securement bracket 20, the two support arms 28 of the yoke lie in symmetrically divergent relation to one another on opposite sides of the harness's midplane $P_M$, and thus angle obliquely downward and laterally outward, preferably at an obtuse angle to one another, on respective sides of the user's median plane $P_M$.

The illustrated embodiment is based on a prototype of the carrying aid, in which each support arm consists of a length of square metal tubing, in which case the two support arms may be seamlessly integral parts of a singular piece of metal tubing that is bent at central region thereof to create the diverging angle between the two support arms 28. In the metal tubing prototype, the attachment member 26 is formed by a bent piece of metal plate that defines both the base 26A and upper hook 26B, of which the base is welded to the tubular metal support arms 28 at a topside of the shared central region by which the support arms are interconnected. The metal construction provides significant strength and rigidity, and maintains a fixed shape of the support yoke 14 over a wide range of load weights to which the carrying aid 10 may be subjected during use. The rigid support yoke 14 thus maintains the distal outer ends 28A of the two support arms 28 at a fixed distance to one another across the midplane $P_M$ of the harness 12. It will be appreciated that in other embodiments this distance not necessarily be a permanently fixed value, as the support arms 28, for example, could be of a telescopic construction allowing some length adjustment of the arm 28 to vary how far they reach from their shared interconnection at the midplane $P_M$, provided that metal or other sufficiently rigid material is used for the telescopically adjustable components so that no bending of either support arm 28 occurs under anticipated loading ranges. While the prototype employed a metal construction, rigid plastics or composites of sufficient strength and rigidity may be employed as alternatives to steel or other sufficiently strong metals. Where metal construction is used, particular use of metal tubing may be preferred over a a solid bar construction in the interest of optimal strength to weight ratio.

Attached to each support arm 28 at the distal end 28A thereof is a respective coupling component 30, for example a snap hook or carabiner, by which detachable connection can be made to a cadaver bag at or near a respective corner thereof, typically by way of handles or handgrip openings attached to or incorporated into the bag construction, as is known in the art and demonstrated, for example, by U.S. Pat. Nos. 8,146,217 and 9,486,380, both of which are incorporated herein by reference in their entirety. Accordingly, to connect the carrying aid 10 to a cadaver bag, the two coupling components 30 of the support yoke 14 are respectively engaged through two openings or handles of the cadaver bag at the two corners at one end of the cadaver bag. This end of the cadaver bag can thus be supported by the wearer of the carrying aid 10 in a hands-free manner via suspension of that end of the cadaver bag from the coupling components 30 at the two opposing ends of the support yoke 14. Likewise, another wearer of another carrying aid 10 connects the coupling components 30 of their support yoke 14 to the two openings or handles situated adjacent the two corners of the other end of the cadaver bag to likewise support this second end of the cadaver bag in a suspended hands-free fashion. The entirety of the cadaver bag, and the decedent body contained therein, can thus be supported in suspended fashion between the wearers of the two carrying aids 10.

Figure 6:
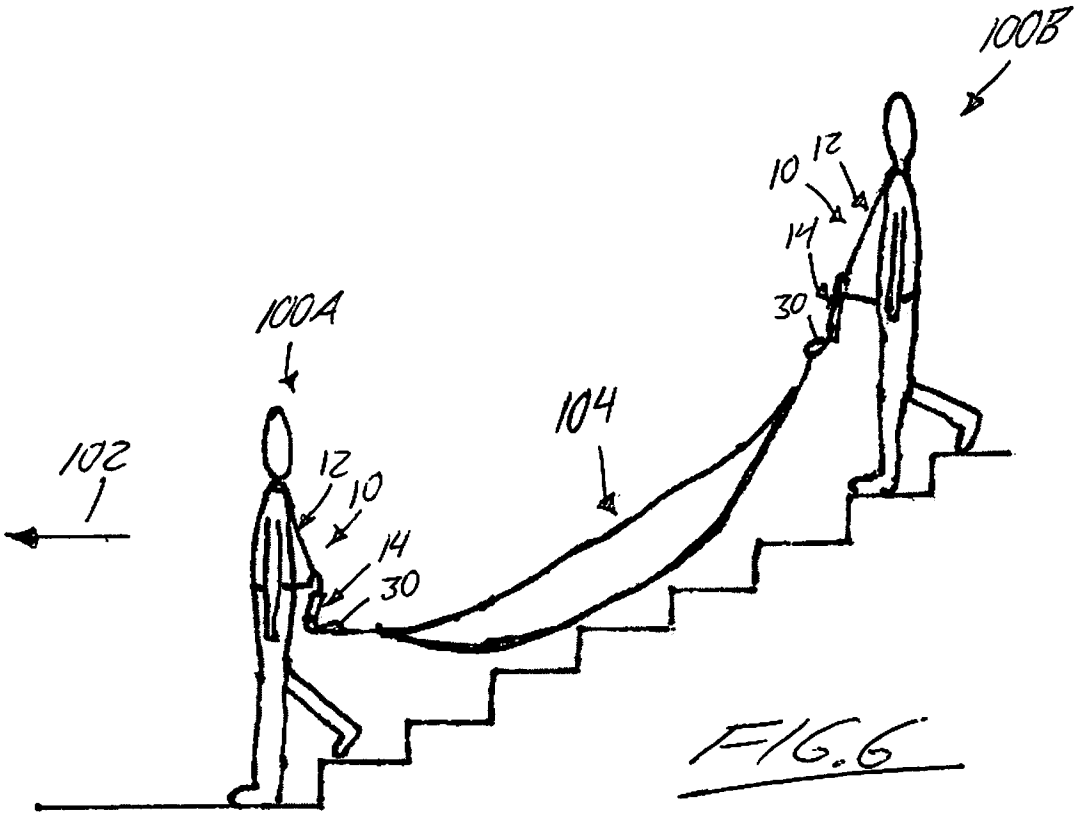
FIG. 6 is a side elevational view illustrating use of two carrying aids by two users to co-operably carry a decedent in a cadaver bag.

An example of this is shown in FIG. 6, where a first user 100A leads a second user 100B in a travel direction 102 in which a decedent is to be carried, and a cadaver bag 104 in which the decedent body is contained is suspended between the support yokes 14 of the two users. The first user 100A wears their carrying aid in the rear working position placing the securement bracket 20 and attached support yoke 14 behind the user, while the second user wears their carrying in the front working position placing the securement bracket 20 and attached support yoke 14 in front of the user, whereby the two user's can both face and walk forwardly in the travel direction. Alternatively, both carrying devices may be worn in the front working position with the two users facing toward one another, with one user walking forward in the travel direction, and the other user walking backward in the travel direction. With the cadaver bag suspended by its four corners between the support yokes 14 of the two users in hands-free fashion, each user maintains free range of their hands, for example to aid with their support and balance as they share the load of the decedent's body weight between them, thus making it easier to navigate difficult terrain, challenging environments or constrained spaces compared to conventional hand-carrying of a loaded cadaver bag.

The use of the yoke with two diverging support arms to support two coupling components 30 at approximately shoulder-width apart in anterior or posterior relation to the wearer's body is particularly advantageous to carrying of a cadaver bag by its corners, unlike the prior art where stretchers or litters have carrying poles by which they can be suspended by harness-borne loops worn at positions situated laterally aside the user's waist or hips.

Although the carrying aid 10 of the present invention was designed with this particular cadaver-carrying application in mind, it will be appreciated that the inventive carrying aid 10 may also be used in other load-carrying applications where the load is something other than a cadaver, and when the load-carrier suspended between the two carrying aids is accordingly something other than a cadaver bag. For example, a pair of the carrying aids 10 may be used for moving furniture, appliances or other bulky and/or heavy loads, for example on a pair of carrier straps each suspended between one of the support arms of the first user's support yoke and one of the support arms of the second user's support yoke. In such embodiment, instead of carabiners or snap hooks suitable for clipped connection to handles or grip openings of a cadaver bag, other coupling components 30 particularly suited to support the ends of a pair of carrier straps may be employed. Suitable strap fittings for coupling carrier straps to a harness are known in the art of furniture/appliance moving and delivery.

In addition to being useful for bearing a load in a suspended state between two wearers of the device, the carrying aid may also be used as a single person load assistance tool for aiding in pulling or dragging a significant load (e.g. ATV, snowmobile or other vehicle; large game carcass in hunting applications). In such applications, instead of attaching a cadaver bag, a pair of straps, cables, ropes or similar flexible pulling members are attached at one end to the coupling components 30 of the yoke, and tied or otherwise attached at the other end to the load to be pulled. Alternatively, if the load itself has suitable attachment points, each coupling point may be attached directly to the load, rather than to an intermediate carrier or pulling member. Accordingly, though referred to herein as a "carrying aid" in the context of cadaver removal where the load is carried, the invention may also be referred to more generally as a load-moving aid, since the load may be moved by moved in any manner, whether carried, pulled, dragged, etc.

It will also be appreciated that while the illustrated embodiment employs a detachable connection between the securement bracket 20 and the support yoke 14 to enable selective removal of the yoke, other embodiments may employ a more permanent attachment, or even combine the two into a singular component. Accordingly, the term securement member is used to denote the discrete or integral component by which the yoke is secured to the harness, for example by routing of the hardness straps through the described slots 22A, 22B in this securement member, while the yoke refers to the discrete or integral component embodying the two divergent support arms that extend laterally outward from the securement member, whether permanently or releasably attached thereto.

The scope of the claims should not be limited by the preferred embodiments set forth in the detailed examples above, but should be given the broadest interpretation consistent with the overall disclosure as a whole.

The invention claimed is:

1. A load-moving aid comprising:

a body-worn harness comprising flexible webbing forming two shoulder loops of equal size and symmetric relation to one another across a midplane of the body-worn harness for respective wearing of said two shoulder loops over a user's two shoulders in a worn position of said body-worn harness on a user's body;

a securement bracket joining said two shoulder loops together at said midplane of the body-worn harness for cooperative support of said securement bracket by said two shoulder loops at a position residing anteriorly or exteriorly of the user's body at an approximate midway point thereacross in said worn position of said body-worn harness;

a yoke attached to, or configured for selective attachment to, the body-worn harness by the securement member, said yoke having a pair of support arms that diverge in non-parallel relation to one another from a shared connection therebetween at which the yoke is attached, or configured for selective attachment to, the securement member in a position placing said support arms in symmetrical, non-parallel and downwardly divergent relation to one another across the midplane of the body-worn harness; and on each support arm of the yoke, adjacent a distal end of the support arm situated opposite the shared connection between the support arms, a respective connector clip by which the yoke is connectable, directly or indirectly, in clipped fashion to a load to be moved.

2. The load-moving aid of claim 1 wherein said yoke, at least in part, is of a rigid construction operable to maintain the distal ends of the support arms in spaced relation from one another on opposite sides of the shared connection.

3. The load-moving aid of claim 1 wherein, at the shared connection between the support arms, the yoke comprises an attachment component releasably matable with the securement member to selectively attach the yoke thereto.

4. The load-moving aid of claim 3 wherein the attachment component comprises a hooked feature shaped for hooked engagement with the securement bracket through a co-operable attachment opening therein in a manner hanging the yoke from said securement bracket.

5. The load moving aid of claim 1 wherein each connector clip comprises a carabiner or snap hook.

6. The load moving aid of claim 1 in combination a cadaver bag that comprises handles thereon or openings therein at locations adjacent two opposing corners at each end of the cadaver bag, whereby the connector clips of the yoke are connectable to the cadaver bag at said handles or openings at one end of the cadaver bag.

7. The load-moving aid of claim 1 wherein each support arm of the yoke comprises a length of metal tubing.

8. The load-moving aid of claim 1 wherein the yoke comprises a bent piece of metal tubing that is bent at a central region thereof, from which two symmetric halves of the metal tubing diverge from one another in non-parallel fashion.

9. The load moving aid of claim 8 wherein the securement bracket has an attachment opening therein, and the yoke comprises a bent metal plate that is affixed to the central region of the bent piece of metal tubing and is shaped for hooked engagement to the securement bracket through the attachment opening therein in a manner hanging the yoke from said securement bracket.

10. The load moving aid of claim 4 wherein the hooked feature is a bent metal plate affixed to a central region of the yoke.

11. The load moving aid of claim 1 wherein the support arms of the yoke diverge at an oblique angle to one another.

12. The load moving aid of claim 1 wherein the harness is configured for selective wearing thereof by a user in either one of a rear-working position with the support bracket positioned posteriorly of a torso of the user, and a front-working position with the support bracket positioned anteriorly of the torso of the user.

13. The load moving aid of claim 1 wherein said securement bracket has a pair of strap-receiving slots therein, each of which has a singular respective one of the two shoulder loops routed therethrough.

14. A load-moving aid comprising:

a body-worn harness comprising flexible webbing forming two shoulder loops of equal size and symmetric relation to one another across a midplane of the body-worn harness for respective wearing of said two shoulder loops over a user's two shoulders in a worn position of said body-worn harness on a user's body;

a securement bracket joining said two shoulder loops together at said midplane of the body-worn harness for cooperative support of said securement bracket by said two shoulder loops at a position residing anteriorly or exteriorly of the user's body at an approximate midway point thereacross in said worn position of said body-worn harness;

a yoke attached to, or configured for selective attachment to, the body-worn harness by the securement member, said yoke having a pair of support arms that diverge in non-parallel relation to one another from a shared connection therebetween at which the yoke is attached, or configured for selective attachment to, the securement member in a position placing said support arms in symmetrical, non-parallel and downwardly divergent relation to one another across the midplane of the body-worn harness; and on each support arm of the yoke, adjacent a distal end of the support arm situated opposite the shared connection between the support arms, a respective coupling component by which the yoke is connectable, directly or indirectly, to a load to be moved.

15. A loading moving system for cooperative moving of a load by two users, said system comprising:

first and second load moving aids, each comprising:

a body-worn harness comprising first and second halves to be respectively worn over a user's two shoulders in a worn position of said body-worn harness;

a securement member connected to and cooperatively supported by the first and second halves of the body-worn harness at a midplane thereof so as to reside at an approximate midway point across a body of the user in a worn position of said body-worn harness;

a yoke attached to, or configured for selective attachment to, the body-worn harness by the securement member, said yoke having a pair of support arms diverging away from one another from a shared connection therebetween at which the yoke is attached, or configured for selective attachment to, the securement member; and on each support arm of the yoke, adjacent a distal end of the support arm situated opposite the shared connection between the support arms, a respective coupling component by which the yoke is connectable, directly or indirectly, to a load to be moved;

wherein the first load moving aid is wearable by a first user in a rear-working position with the support bracket of the first load moving aid positioned posteriorly of a torso of said first user with the coupling components of the first load moving aid coupled to the load at a first end thereof, and the second load moving aid is wearable by a second user in a front-working position with the support bracket of the second load moving aid positioned anteriorly of a torso of a second user with the coupling components of the second load moving aid coupled to the load at a second end thereof, thereby enabling suspension said load between said first and second users with said first and second users facing in a same common direction as one another.

16. The system of claim 15 further comprising:

a cadaver bag that comprises a first pair of handles thereon, or openings therein, at locations adjacent a first two corners of the cadaver bag at a first end thereof, and a second pair of handles thereon, or openings therein, at locations adjacent a second two corners of the cadaver bag at a second end thereof;

wherein the first load moving aid is wearable by the first user in the rear-working position with the coupling components of the first load moving aid clipped to the cadaver bag through the first pair of handles or openings, and the second load moving aid is wearable by the second user in the front-working position with the coupling components of the second load moving aid clipped to the cadaver bag through the second pair of handles or openings, thereby suspending said cadaver bag between said first and second users with said first and second users facing in a same common direction as one another.

* * * * *